US006420079B1

(12) United States Patent
Morinishi et al.

(10) Patent No.: US 6,420,079 B1
(45) Date of Patent: Jul. 16, 2002

(54) ELECTROPHOTOGRAPHIC TONER AND ELECTROPHOTOGRAPHIC APPARATUS

(75) Inventors: Yasuharu Morinishi, Yamabe-gun; Tatsuo Imafuku, Nara; Junichi Saito, Nara; Yoshiaki Akazawa, Nara; Yuichiro Takesue, Ikoma, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 24 days.

(21) Appl. No.: 09/756,204

(22) Filed: Jan. 9, 2001

Related U.S. Application Data

(63) Continuation of application No. 09/638,875, filed on Aug. 15, 2000, now abandoned.

(30) Foreign Application Priority Data

Sep. 27, 1999 (JP) ..... 11-273110

(51) Int. Cl.[7] ..... G03G 9/00

(52) U.S. Cl. ..... 430/108.6; 430/108.1; 430/108.3; 399/117; 399/252

(58) Field of Search ..... 430/108.1, 108.3, 430/108.6; 399/117, 252

(56) References Cited

U.S. PATENT DOCUMENTS 5,747,211 A * 5/1998 Hagi et al. ..... 430/110
5,800,959 A * 9/1998 Ikami ..... 430/111
5,811,214 A * 9/1998 Osterhoudt et al. ..... 430/110
5,981,132 A * 11/1999 Kurose et al. ..... 430/111
6,001,527 A * 12/1999 Ishihara et al. ..... 430/110
6,103,441 A * 8/2000 Tomita et al. ..... 430/111
6,132,920 A * 10/2000 Hagi et al. ..... 430/110

FOREIGN PATENT DOCUMENTS

JP 8-137124 A * 5/1996

* cited by examiner

*Primary Examiner*—Mark Chapman
(74) *Attorney, Agent, or Firm*—Nixon & Vanderhye P.C.

(57) ABSTRACT

An electrophotographic toner constituting a dual component is composed of toner base particles and fine inorganic particles having a volume mean diameter of 250 to 600 nm with a specific surface area of 0.25 to 0.5 $m^2/g$ for serving as an abrasive, and is characterized in that 1.5 to 2 parts by weight of the abrasive is externally added to 100 parts by weight of the toner base particles and made to be deposited over the toner base particle surface. Also, the above electrophotographic toner is used for an electrophotographic apparatus which includes a photoreceptor cleaning device located above the level that passes through the center of the photoreceptor drum.

6 Claims, No Drawings

ELECTROPHOTOGRAPHIC TONER AND ELECTROPHOTOGRAPHIC APPARATUS

This is a continuation of application Ser. No. 09/638,875, filed Aug. 15, 2000, now abandoned, the entire content of which is hereby incorporated by reference in this application.

BACKGROUND OF THE INVENTION (1) Field of the Invention

The present invention relates to an electrophotographic toner and an electrophotographic apparatus, and in particular relates to an electrophotographic toner which has fine particles externally added so as to provide an abrading effect and refresh the photoreceptor surface well as relating to an elect:rophotographic apparatus having an efficiently functional developing system.

(2) Description of the Prior Art

Conventionally, the electrophotographic technique, the application of the Carlson process, has been widely used for image forming using the toner. An apparatus using the Carlson process typically uses a photoreceptor drum having a photosensitive layer on the surface thereof and has a charger, an exposing device, a developing device, a transfer device, a fixing device, a cleaner and an erasing device, all arranged around the photoreceptor drum in the mentioning order. Now, the Carlson process will be explained. In this process, first in the dark place, the photoreceptor drum surface is uniformly charged by the charger. Then, the exposing device illuminates the photoreceptor drum surf ace with a light image of a document so as to release charge at the areas which have been illuminated with light, thus forming an electrostatic latent image on the photoreceptor drum surface.

Next, the toner which has been charged with a polarity that is opposite to the electric field of charge on the photoreceptor drum adheres to this static latent image so as to develop the static latent image into a visual image. Thereafter, a recording material such as paper is laid over the visual image while charge with a polarity opposite to the toner is given to the rear side of the recording material by corona discharge from the transfer device, whereby the toner image is transferred to the recording material. After the transfer step, the toner image is fixed to the recording material by the heat and pressure from the fixing device, forming a permanent image.

The leftover toner that has not transferred to the recording material and remains on the photoreceptor drum is removed by the cleaner. The static latent image on the photoreceptor drum is charge erased by the erasing device. Thereafter, the above process, starting with charging of the photoreceptor drum, is repeated so as to effect continual image forming. The toner to be used for the electrophotocraphic technology using the above-mentioned Carlson process is a coloring powder forming visual images and also has the charge function and the fixing function to recording materials. Further, the toner is given with various functions, depending upon the properties of the apparatus to which the toner is used.

As one of the functions of the toner, the toner performs the function of abrading the photoreceptor and refreshing the photoreceptor surface when the toner remaining on the photoreceptor surface after the transfer stage is removed. This function is mainly attributed to inorganic particles externally deposited over the toner surface. In order to make the function of refreshing the photoreceptor surface more efficient, Japanese Patent Application Laid-Open Hei 8 No.137124 discloses a technique for uniformly dispersing the abrasive over the toner surface by preliminary mixing of the abrasive and a fluidizer and then blending them with the toner particles by a large-scale mixer.

However, if fine particles having abrading effect are externally added to the toner by this method, the particles themselves may firmly Stick to the photoreceptor surface and produce image deficiencies.

SUMMARY OF THE INVENTION

The present invention has been devised in view of the above drawbacks and it is therefore an object of the present invention to provide an electrophotographic toner which provides the function of refreshing the photoreceptor surface without causing any damage to the images and also provide an electrophotographic apparatus having a developing system providing the optimized effective function.

The inventors hereof have made various investigations in order to solve the above drawbacks and have found out the new fact that a toner can produce the function of refreshing the photoreceptor surface without causing any deficiency by limiting the volume mean diameter, specific surface area and the mixing ratio of the fine inorganic particles eternally added and adhering to the toner to associated specified ranges and thus have completed the invention.

In order to achieve the above object, the present invention is configured as follows:

In accordance with the first aspect of the present invention, an electrophotographic toner constituting a dual component developer in combination with a powdered magnetic carrier, comprises:

toner base particles made up of a binder resin containing a coloring agent and the like with a fluidizer and other particles adhering to the surface thereof; and fine inorganic particles having a volume mean diameter of 250 to 600 nm (i.e., 0.25 to 0.6 $\mu$m) with a specific surface area of 0.25 to 0.5 $m^2/g$ for serving as an abrasive, and is characterized in that 1.5 to 2 parts by weight of the abrasive is externally added to 100 parts by weight of the toner base particles and made to be deposited over the toner base particle surface.

In accordance with the second aspect of the present invention, the electrophotographic toner having the above first feature is characterized in that the fine inorganic particles are made to be externally deposited over the toner base particle surface by blending the two components in a mixer for 30 to 90 seconds with the mean linear speed of the mixer's agitator blade set at 600 m/min to 900 m/min.

In accordance with the third aspect of the present invention, an electrophotographic apparatus for performing an electrophotographic process using a dual-component developer made up of a toner and a powered magnetic carrier, comprises: a photoreceptor cleaning device is located above the level that passes through the center of the photoreceptor drum, and is characterized in that the electrophotographic toner constituting a dual component developer in combination with a powdered magnetic carrier, comprises: toner base particles made up of a binder resin containing a coloring agent and the like with a fluidizer and other particles adhering to the surface thereof; and fine inorganic particles having a volume mean diameter of 250 to 600 nm (i.e., 0.25 to 0.6 $\mu$m) with a specific surface area of 0.25 to 0.5 $m^2/g$ for serving as an abrasive, and that 1.5 to 2 parts by weight of the abrasive is externally added to 100 parts by weight of the toner base particles and made to be deposited over the toner base particle surface.

In accordance with the fourth aspect of the present invention, the electrophotographic apparatus using an electrophotographic toner, having the above third feature, is characterized in that the fine inorganic particles are made to be externally deposited over the toner base particle surface by blending the two components in a mixer for 30 to 90 seconds with the mean linear speed of the mixer's agitator blade set at 600 m/min to 900 m/min.

In accordance with the fifth aspect of the present invention, an electrophotographic apparatus for performing an electrophotographic process using a dual-component developer made up of a toner and a powered magnetic carrier, comprises:

a photoreceptor drum having a diameter of 30 to 40 mm and rotating at a linear speed of 80 mm/s or higher, and is characterized in that the electrophotographic toner constituting a dual component developer in combination with a powdered magnetic carrier, comprises: toner base particles made up of a binder resin containing a coloring agent and the like with a fluidizer and other particles adhering to the surface thereof; and fine inorganic particles having a volume mean diameter of 250 to 600 nm (i.e., 0.25 to 0.6 $\mu$m) with a specific surface area of 0.25 to 0.5 $m^2/g$ for serving as an abrasive, and that 1.5 to 2 parts by weight of the abrasive is externally added to 100 parts by weight of the toner base particles and made to be deposited over the toner base particle surface.

In accordance with the sixth aspect of the present invention, the electrophotographic apparatus using an electrophotographic toner, having the above fifth feature is characterized in that the fine inorganic particles are made to be externally deposited over the toner base particle surface by blending the two components in a mixer for 30 to 90 seconds with the mean linear speed of the mixer's agitator blade set at 600 m/min to 900 m/min.

DESCRIPTION OF THE PREFERRED EMBODIMENTS

The embodiments of the present invention will hereinafter be described in detail.

The toner base particles to be handled in the present invention may be of publicly known toner particles which have been conventionally used in the dry development system Such toner particles are produced by dispersing a coloring agent and other additives in a fixer resin. Here, various types of thermoplastic resin can be employed as the fixer resin, but acrylic polymers and styrene-acrylic copolymers are preferably used and in particular styrene-acrylic copolymers are most preferable.

As the coloring agent dispersed in the fixer resin, carbon black, alloy azo-dyes, other oil-based dyes and pigments are known and can be used as appropriate. An amount of 1 to 30 parts, preferably 2 to 20 parts by weight of such coloring agents is added to 100 parts by weight of the fixer resin. Additives other than the coloring agents include, for example, charge control agents, anti-offset agents, etc.

Here, the charge control agent is blended in order to control the tribo-electrification performance of the toner. There are two types of charge control agents, the positive charge control type and the negative charge control type. The anti-offset agent is blended in order to provide anti-offset effect for the toner. A variety of anti-offset agents have been known and can be used as appropriate. Typically, an amount of 0.1 to 10 parts, preferably 0.5 to 8 parts by weight of a charge control agent is added to 100 parts by weight of the fixer resin while an amount of 0.1 to 10 parts, preferably 0.5 to 8 parts by weight of an anti-offset agent is added to 100 parts by weight of the fixer resin.

The toner base particles to which the present invention is applied are prepared by fusing and kneading, for example, the fixer resin, coloring agent and other additives, and then crushing the resultant material by crushing and classification of the obtained particles. The toner base particles used in this case should have a mean particle size of 5 to 15 $\mu$m, preferably 7 to 12 $\mu$m. Usually, a fluidizer such as silica, titanium oxide, alumina or the like is deposited on the surface of the toner base particles.

Particularly, silica is the most preferable in view of improving the fluidity. The fluidizer used in this case should have a mean particle size of 0.1 $\mu$m or below, preferably 0.005 to 0.05 $\mu$m, so that its mean particle size is much smaller than that of the abrasive made up of fine inorganic particles described hereinbelow.

In the present invention, the timing when fluidizer is made to be deposited on the toner base particle surface should not be limited. For example, the fluidizer may be uniformly mixed beforehand with the toner base particles in a mixer so as to uniformly adhere thereto and then the aftermentioned abrasive is made to be externally deposited. Alternatively, the abrasive and the fluidizer may be mixed altogether with the toner base particles so that the fluidizer as well as the abrasive will be made to be externally deposited over the toner base particle surface.

Examples of the abrasive used in the electrophotographic toner of the present invention include fine inorganic particles of magnetite, alumina, cerium oxide, strontium titanate, etc., and magnetite, alumina and the mixture thereof are particularly preferred.

Here in the present invention, it is essential that the abrasive should have a volume mean diameter of 250 to 600 nm, preferably 290 to 550 nm, with a specific surface area of 0.25 to 0.5 $m^2/g$, preferably 0.29 to 0.5 $m^2/g$ and that 1.5 to 2 parts by weight of the abrasive should be externally added to 100 parts by weight of the toner base particles and made to be deposited over the toner base particle surface.

Here, when the particle size (volume mean diameter) of the fine inorganic particles to be externally deposited is smaller than the above specified value, such particles of smaller diameters are liable to drop off the toner base particle surface because the surface area per grain of a smaller particle is smaller compared to that of a greater particle and the contact area with the toner base particle becomes smaller. The fine inorganic particles having fallen off are pressed against the photoreceptor drum by the cleaning blade and caused to adhere to the photoreceptor drum surface when it scrapes the untransferred toner from the photoreceptor drum surface. As a result, deficiencies appearing on the rotational cycle of the drum would occur in the image. On the other hand, with the particle size (volume mean diameter) of the fine inorganic particles greater than the above specified value, even when some part of the fine inorganic particles has fallen off the base particles, the fine inorganic particles not having fallen off and remaining deposited on the toner surface will provide the scraping function so as to reduce the adhesion of the fine inorganic particles to the drum.

With the volume mean diameter of the particles specified within the constant range, the particles will have more irregularities on the surface thereof as they have a greater specific surface area than the aforementioned specified value. As the fine inorganic particles externally added as the abrasive have more irregularities on the surface thereof, the function of abrading the photoreceptor drum surface become stronger. Accordingly, the function is effective enough in scraping the fine inorganic particles having fallen from the toner surface and becoming deposited on the photoreceptor drum surface, whereby it is possible to prevent image defect:s occurring due to adherence of the fine inorganic particles onto the photoreceptor drum. However, if the specific area becomes too large beyond the above specified value, the abrading function decreases, so that the fine inorganic particles adhering to the drum cannot be scraped, producing an unwanted result.

Next, when the fine inorganic particles as the abrasive is externally added in an amount lower than the aforementioned specified value, the fine inorganic particles which have fallen from toner base particles and adhered to the photoreceptor drum becomes less in number. Accordingly, the possibility of occurrence of image defects due to filming becomes smaller. However, the originally intended function as the abrasive (the functions of scraping the deposit on the drum and refreshing the drum surface) is also degraded. Further, the fine inorganic particles externally added as the abrasive have the function of scraping the fine inorganic particles which have fallen from the toner base particles and adhered to the photoreceptor drum, from the photoreceptor drum, by their own abrading force. Therefore, when the added amount increases and exceeds a certain level, image deficiencies due to filming decrease.

Since the fine inorganic particles externally added as the abrasive is conductive, they functions to leak electric charge from the toner. Therefore, if the fine inorganic particles are added in excess of the aforementioned specified value, the quantity of charge on the toner decreases, causing deficiencies such as toner scatter, fogging and the like.

Thus, the above problems can be solved by specifying the abrasive used in the present invention so as to meet both requirements of the volume mean diameter being 250 nm or greater, preferably 290 to 550 nm and the specific surface area being 0.25 to 0.5 $m^2/g$, preferably 0.29 to 0.5 $m^2/g$, and blending 1.5 to 2 parts by weight of the abrasive with 100 parts by weight of the toner base particles, so that the abrasive is made to be externally deposited on the toner base particles.

In the present invention, at the stage of externally adding the abrasive to and mixing it with the toner, blending in the mixer is performed for 30 to 90 seconds with the mean linear speed of the mixer's agitator blade set at 600 m/min to 900 m/min.

Here, when external addition and blending is performed in a high-shear field which can be obtained by enhancing the linear speed of rotation of the agitating blade of the mixer, it is possible to give strong impacts between the external additive and the base particles when they collide against each other in the mixer. As a result, it is possible to cause the fine inorganic particles to firmly adhere to the toner base particle surface. Therefore, it is possible to prevent the fine inorganic particles from dropping off in a more effective manner if external addition is performed by high-speed agitation.

If the shear force during external addition and blending is too strong, the fine inorganic particles externally added as the abrasive are forced to become embedded into the interior of the base particles, so that the originally intended function as the abrasive (the functions of scraping the deposit on the drum and refreshing the drum surface) is degraded. This means that too much enhancement of the rotational speed of the agitator blade in the mixing device is not favorable. That is, there is an optimal operating range of the linear speed of rotation of the agitator blade of the mixer in order to produce a toner having the effect of abrading the photoreceptor without causing any harmful effect. As a result of the investigation in this view point, the optimal operating range at the stage of externally adding the abrasive to and mixing it with the toner, has been found that blending in the mixer is performed for 30 to 90 seconds with the mean linear speed (the speed of the mid blade) of the agitator blade set at 600 m/min to 900 m/min.

Next, in a dual-component development electrophotographic process using the toner and a powdered magnetic carrier as in the present invention, when the copier or printer has a photoreceptor cleaning device (unit) arranged above the level passing through the center of the photoreceptor drum, the untransferred toner remaining on the photoreceptor drum is scraped by the cleaning blade and then the scraped toner particles move in contact with the drum surface as they are conveyed to a collecting box. Accordingly, the collected toner comes into contact with the photoreceptor drum more often compared to a configuration where the photoreceptor cleaning device is located in the lower position of the photoreceptor, and hence the fine inorganic particles having fallen from the base particles become likely to adhere to the photoreceptor drum. Further, this arrangement is also more advantageous in saving space, constituting a used toner recycling system, and designing the other apparatus configuration. Therefore, the electrophotographic toner of the present invention as specified above is particularly effective when used in such an electrophotographic apparatus.

From the viewpoint of space saving of the system, a copier/printer having a small-diametric photoreceptor drum that rotates at a higher speed is advantageous. However, the untransferred toner tends to pass through the nip between the cleaning blade and the photoreceptor surface. To deal with this, it is necessary to enhance the squeezing pressure of the cleaning blade. This causes the toner held between the blade and the photoreceptor drum to be stressed greatly, the fine inorganic particles on the base particle surface are liable to drop off. However, it is particularly effective when the above-described electrophotographic toner of the present invention is used in an electrophotographic apparatus having a photoreceptor drum having a diameter of 30 to 40 mm with its linear velocity set at 80 mm/s or greater.

Now, the specific examples of the present invention will be described.

The producing method of the toner used in the examples and evaluating method are as follows:

(1) The Toner Producing Method

The fixing resin, coloring agents and other starting materials shown in Table 1 are mixed by a Henschel mixer (FM150, 5000 rpm, a produce of MITSUI MINING Co. LTD) and the mixture is fused and kneaded by a biaxial extrusion type kneader and then cooled. The resultant is crushed by jet milling so that the grains are classified to prepare surface-untreated toner having a mean particle size of 9.5 μm. Then, the surface-untreated toner and hydrophobic silica as the fluidizer are mixed by the Henschel mixer in the ratio shown in Table 2 to provide abrasive-untreated toner. Finally, a controlled amount of fine inorganic particles (magnetite powder) having a different volume mean diameter (nm) and specific area ($m^2/g$) shown in Table 3 is added as the abrasive and mixed by the Henschel mixer under the conditions shown in Table 3 to prepare a different externally-additive treated toner.

TABLE 1

Surface-untreated toner prescription

| Starting materials | Mixing ratio |
|---|---|
| Styrene-acrylic copolymer resin | 100 parts by weight |
| Carbon black | 5 parts by weight |
| Alloy azo-dye | 2 parts by weight |
| Polypropylene wax | 1 part by weight |

TABLE 2

Surface-treatment prescription

| Starting materials | Mixing ratio |
|---|---|
| External additive-untreated toner | 100 parts by weight |
| Hydrophobic silica | 0.5 part by weight |

(2) The Producing Method of an Initial Toner

Each externally additive-treated toner obtained at (1) is mixed with an iron powder having a mean particle size of 60 μm using a Nauta mixer (Lab-mixer LV-0, a product of Hosokawa Micron Corporation) so that the toner concentration is adjusted to 7.5% by weight.

(3) The Method of Evaluation

The evaluation items of the print characteristics and the measuring methods are as follows:

1) Observation on Magnetite Filming after Actual Printing

Each initial developer obtained at (2) is set in electrostatic copier (AR-200, a product of Sharp Kabushiki Kaisha) and a 10 K sheet actual copy run was performed with an A4 document of 6% characters.

Then, an A3 black solid document is duplicated on an A3 recording sheet. In this case, if the magnetite power is deposited on the photoreceptor drum surface, white spots or voids appear on the black solid image. The number of the white spots on each A3 sheet sample is counted.

2) Evaluation on Fogging

After the actual running at 1), three copies of an A4 blank document are formed. In this case, A4sized white paper of which the whiteness was measured beforehand by a Hunter whiteness meter (NIPPON DENSHOKU INDUSTRIES CO., LTD.) was used as the recording paper. The whiteness of this A4 size white paper after the A4 blank document duplicated thereon was measured again by the Hunter whiteness meter. The difference in whiteness before and after the duplication of the blank document was assumed as fogging. The average fogging value for three sheets was defined as the degree of fogging and each sample was evaluated based on the following criteria:

AA: Whiteness 0.2 or below;

A: Whiteness 0.2 to 0.7;

C Whiteness 0.7 or above.

3) Evaluation on Toner Scatter

After the actual running at 1), the developing unit was taken out from the copier so that the amount of the toner scattering around the magnet roller was checked by visual observation. Each sample was evaluated based on the following criteria:

AA: No conspicuous toner adherence around the developing hopper is found;

A: Partial thin toner adherence around the developing hopper is found;

C Total toner adherence around the developing hopper is found.

4) Evaluation on Reduction in the Coating Thickness of the Photoreceptor Drum

After the actual running at 1), the photoreceptor drum was taken out from the copier so that the coating thickness of the photosensitive layer was measured by a coating thickness meter (MCDP-1100, a product of Otsuka Electronics) so that reduction in coating thickness (μm) was determined by comparing the measurement with the coating thickness at the start of the actual running.

EXAMPLES 1 TO 8, COMPARATIVE EXAMPLES 1 TO 7

Each initial developer with the externally additive-treated toner was set in an electrostatic copier (AR-200, a product of Sharp Kabushiki Kaisha) and the aforementioned printing characteristics were evaluated. The result is shown in Table 3.

In order to save space, the electrostatic copier used here has a cleaning device arranged above the level passing through the center of the photoreceptor drum and uses a photoreceptor having a drum diameter of 30 mm and rotating at a linear speed of 88 mm/s in order to make the copy speed as high as possible. Examples 1 to 8 shown in Table 3 are the externally additive-treated samples meeting the requirements of the present invention. These all presented good results, providing efficient effect on abrading the photoreceptor drum with lower levels of the filming of the externally additive magnetite and lower degrees of fogging and toner scattering.

In contrast to this, as seen in comparative examples 2 to 5, when an external additive magnetite having a volume mean diameter and a specific surface falling out of the specifications defined by the present invention was used, problems occurred concerning the filming or the function of abrading the photoreceptor drum coating. Further, as seen in comparative example 1, the toner with a lower amount of the additive added compared to the specified amount in the present invention presented good filming performance but a poor function of abrading the photoreceptor drum coating. As shown in comparative examples 6 to 7, the toner with a greater amount of the additive added presented poor result as to fogging and toner scattering. From these results, it was confirmed that the specifications of the present invention are effective in producing beneficial toner.

TABLE 3

| | Fine inorganic particle external additive | | | Mixer's | Mixing | | | | |
|---|---|---|---|---|---|---|---|---|---|
| | Added amount (by weight) | Volume mean diameter (nm) | Specific surface area ($m^2/g$) | mean linear speed (m/min) | time for external additive (sec) | Filming | Amount of film abrasion ($\mu m$) | Fogging | Scatter |
| CEx.1 | 1.0 | 368 | 0.36 | 700 | 60 | 3 | 0.03 | AA | AA |
| CEx.2 | 1.5 | 141 | 0.19 | 700 | 60 | 22 | 0.03 | AA | AA |
| CEx.3 | 1.5 | 143 | 0.28 | 700 | 60 | 15 | 0.03 | AA | AA |
| CEx.4 | 2.0 | 141 | 0.19 | 700 | 60 | 22 | 0.03 | AA | A |
| CEx.5 | 2.0 | 151 | 0.36 | 700 | 60 | 11 | 0.10 | A | A |
| CEx.6 | 2.5 | 402 | 0.40 | 700 | 60 | 2 | 0.15 | C | C |
| CEx.7 | 3.0 | 397 | 0.40 | 700 | 60 | 1 | 0.15 | C | C |
| CEx.8 | 2.0 | 298 | 0.29 | 500 | 20 | 13 | 0.20 | A | A |
| CEx.9 | 1.5 | 298 | 0.29 | 500 | 40 | 12 | 0.20 | AA | AA |
| CEx.10 | 1.5 | 298 | 0.29 | 1100 | 80 | 13 | 0.04 | AA | AA |
| CEx.11 | 1.5 | 298 | 0.29 | 1100 | 100 | 14 | 0.05 | AA | AA |
| Ex.1 | 2.0 | 298 | 0.29 | 700 | 60 | 8 | 0.13 | A | A |
| Ex.2 | 2.0 | 293 | 0.47 | 700 | 60 | 7 | 0.12 | A | A |
| Ex.3 | 2.0 | 415 | 0.40 | 700 | 60 | 6 | 0.16 | A | A |
| Ex.4 | 2.0 | 521 | 0.28 | 700 | 60 | 7 | 0.20 | A | A |
| Ex.5 | 1.5 | 298 | 0.29 | 700 | 60 | 8 | 0.10 | AA | AA |
| Ex.6 | 1.5 | 293 | 0.47 | 700 | 60 | 7 | 0.20 | AA | AA |
| Ex.7 | 1.5 | 415 | 0.40 | 700 | 60 | 6 | 0.18 | AA | AA |
| Ex.8 | 1.5 | 521 | 0.28 | 700 | 60 | 7 | 0.19 | AA | AA |
| Ex.9 | 2.0 | 298 | 0.29 | 630 | 40 | 9 | 0.18 | A | A |
| Ex.10 | 2.0 | 298 | 0.29 | 630 | 80 | 10 | 0.20 | A | A |
| Ex.11 | 2.0 | 298 | 0.29 | 780 | 40 | 9 | 0.17 | A | A |
| Ex.12 | 2.0 | 298 | 0.29 | 780 | 80 | 10 | 0.18 | A | A |
| Ex.13 | 1.5 | 298 | 0.29 | 630 | 40 | 9 | 0.17 | AA | AA |
| Ex.14 | 1.5 | 298 | 0.29 | 630 | 80 | 10 | 0.11 | AA | AA |
| Ex.15 | 1.5 | 298 | 0.29 | 780 | 40 | 9 | 0.17 | AA | AA |
| Ex.16 | 1.5 | 298 | 0.29 | 780 | 80 | 10 | 0.11 | AA | AA |

EXAMPLES 9 TO 16 AND COMPARATIVE EXAMPLES 8 TO 11

Examples 9 to 16 shown in Table 3 are evaluation results of the printing performance of the samples where the external additive-treatment was performed with the means linear speed and external additive mixing time (sec) of the mixer varied within the range of meeting the requirements of the present invention. These all presented good results, providing efficient effect on abrading the photoreceptor drum with lower levels of the filming of the externally additive magnetite and lower degrees of fogging and toner scattering.

In contrast to this, as seen in comparative examples 8 to 11, where external additive-treatment was performed with the mixer set in the conditions out of the specifications of the present invention, the resultant toners presented poor results in respect to filming and abrading effect on the photoreceptor drum coating, compared with examples 9 to 16 using the externally additive-treated toners. From these results, it was confirmed that the specifications of the present invention are effective in producing a beneficial toner.

COMPARATIVE EXAMPLE 12

The same evaluation was made using the same externally-additive treated toner sample as in example 1 in the same electrostatic copier (AR-200, a product of Sharp Kabushiki Kaisha) as used in example 1 but modified so that the cleaning blade was located directly below the center of the photoreceptor drum. In this case, the cleaning blade was set so as to abut the photoreceptor with the same angle and the same squeezing pressure as that in the preceding evaluation. The result is shown in Table 4 together with example 1.

From Table 4, this comparative example presented a lower degree of the filming of the externally additive magnetite compared to example 1 where the cleaning blade was arranged in the normal position (on the upper side of the photoreceptor drum). This means that positioning the cleaning blade on the lower side with respect to the drum center is advantageous with regards to the filming of the externally added magnetite. However, since the cleaning unit is arranged on the lower side of the drum, the apparatus inevitably becomes bulky and complex, needing more space and more complicated arrangement for a used toner recycling system. Therefore, to overcome the drawbacks, the approach of configuring a system where the cleaning unit is arranged on the upper side of the photoreceptor drum while the toner is controlled to suppress the filming is markedly effective. Use of the toner of the present invention is effective in making most use of the above merit, so the present invention is beneficial.

EXAMPLES 17 TO 20

The same evaluation was made using the same externally-additive treated toner sample as in example 1 in the electrostatic copier (AR-200, a product of Sharp Kabushiki Kaisha), in which a modified photoreceptor drum having a diameter of 35 mm or 40 mm was driven at various linear speeds. Here, electrostatic copier AR-200 employed a photoreceptor drum having a diameter of 30 mm with the cleaning unit set at the normal position (on the upper side of the photoreceptor drum) in order to save space for the system as stated above.

In this case, the cleaning blade was set so as to abut the photoreceptor with the same angle and the same squeezing pressure as that in the preceding evaluation. The evaluation result indicates that with the increase in the diameter of the photoreceptor drum, the drum has less filming of the exter nally additive magnetite and presents beneficial performance. The result is summarized in Table 4.

TABLE 4

| Item | Cleaning unit position | Photoreceptor drum size (mm) | Photoreceptor drum linear speed (mm/s) | Filming (pieces) |
|---|---|---|---|---|
| Ex. 1 | on the upper side of photoreceptor drum | 30 | 88 | 8 |
| CEx. 12 | on the lower side of photoreceptor drum | 30 | 88 | 3 |
| CEx. 17 | on the upper side of photoreceptor drum | 35 | 88 | 6 |
| CEx. 18 | on the upper side of photoreceptor drum | 40 | 88 | 4 |
| CEx. 19 | on the upper side of photoreceptor drum | 30 | 70 | 3 |
| CEx. 20 | on the upper side of photoreceptor drum | 30 | 80 | 6 |

From Table 4, the greater the diameter of the photoreceptor drum was, the filming occurred less in number. When the linear speed of the photoreceptor drum was varied, the filming of the externally added magnetite became less in number with reduction in the linear speed of the photoreceptor drum.

Accordingly, a configuration with a photoreceptor drum greater in diameter and rotating at a lower linear speed is more advantageous with regards to the filming of the externally added magnetite. However, since the largeness of the drum diameter causes difficulty in space saving and the lowness of the drum linear speed is at a disadvantage in realizing the high-speed copying operation, the apparatus inevitably becomes bulky and complex. Therefore, to overcome the drawbacks, the approach of configuring a system where the toner is controlled to suppress the filming is markedly effective.

According to the present invention, it is possible to provide the beneficial function of abrading the photoreceptor drum coating and hence produce the refreshing effect without causing any deficiency by limiting the volume mean diameter, specific surface area and the mixing ratio of the fine inorganic particles externally added and adhering to the toner to associated specified ranges. Therefore, the toner of the present invention will not cause much fogging and toner scattering and presents excellent performance as an electrophotographic toner which constitutes a dual component developer in combination with magnetic powder carriers.

What is claimed is:

1. An electrophotographic toner constituting a dual component developer in combination with a powdered magnetic carrier, comprising:

toner base particles made up of a binder resin containing a coloring agent and the like with a fluidizer and other particles adhering to the surface thereof; and fine inorganic particles having a volume mean diameter of 250 to 600 nm (i.e., 0.25 to 0.6 $\mu$m) with a specific surface area of 0.25 to 0.5 $m^2/g$ for serving as an abrasive, characterized in that 1.5 to 2 parts by weight of the abrasive is externally added to 100 parts by weight of the toner base particles and made to be deposited over the toner base particle surface.

2. The electrophotographic toner according to claim 1, wherein the fine inorganic particles are made to be externally deposited over the toner base particle surface by blending the two components in a mixer for 30 to 90 seconds with the mean linear speed of the mixer's agitator blade set at 600 m/min to 900 m/min.

3. An electrophotographic apparatus for performing an electrophotographic process using a dual-component developer made up of a toner and a powered magnetic carrier, comprising: a photoreceptor cleaning device is located above the level that passes through the center of the photoreceptor drum, characterized in that the electrophotographic toner constituting a dual component developer in combination with a powdered magnetic carrier, comprises: toner base particles made up of a binder resin containing a coloring agent and the like with a fluidizer and other particles adhering to the surface thereof; and fine inorganic particles having a volume mean diameter of 250 to 600 nm (i.e., 0.25 to 0.6 $\mu$m) with a specific surface area of 0.25 to 0.5 $m^2/g$ for serving as an abrasive, and that 1.5 to 2 parts by weight of the abrasive is externally added to 100 parts by weight of the toner base particles and made to be deposited over the toner base particle surface.

4. The electrophotographic apparatus using an electrophotographic toner, according to claim 3, wherein the fine inorganic particles are made to be externally deposited over the toner base particle surface by blending the two components in a mixer for 30 to 90 seconds with the mean linear speed of the mixer's agitator blade set at 600 m/min to 900 m/min.

5. An electrophotographic apparatus for performing an electrophotographic process using a dual-component developer made up of a toner and a powered magnetic carrier, comprising:

a photoreceptor drum having a diameter of 30 to 40 mm and rotating at a linear speed of 80 mm/s or higher, characterized in that the electrophotographic toner constituting a dual component developer in combination with a powdered magnetic carrier, comprises: toner base particles made up of a binder resin containing a coloring agent and the like with a fluidizer and other particles adhering to the surface thereof; and fine inorganic particles having a volume mean diameter of 250 to 600 nm (i.e., 0.25 to 0.6 $\mu$m) with a specific surface area of 0.25 to 0.5 $m^2/g$ for serving as an abrasive, and that 1.5 to 2 parts by weight of the abrasive is externally added to 100 parts by weight of the toner base particles and made to be deposited over the toner base particle surface.

6. The electrophotographic apparatus using an electrophotographic toner, according to claim 5, wherein the fine inorganic particles are made to be externally deposited over the toner base particle surface by blending the two components in a mixer for 30 to 90 seconds with the mean linear speed of the mixer's agitator blade set at 600 m/min to 900 m/min.

* * * * *